US005745026A

United States Patent [19]

Kokubu et al.

[11] Patent Number: 5,745,026

[45] Date of Patent: Apr. 28, 1998

[54] VEHICULAR COMMUNICATION SYSTEM USING AN IGNITION KEY

[75] Inventors: Sadao Kokubu; Hisashi Aoki; Takashi Mizuno; Shinichi Koga, all of Niwa, Japan

[73] Assignee: Kabushiki Kaisha Tokai-Rika-Denki-Seisakusho, Aichi-ken, Japan

[21] Appl. No.: 782,630

[22] Filed: Jan. 10, 1997

[30] Foreign Application Priority Data

Jan. 11, 1996 [JP] Japan ..... 8-003126

[51] Int. Cl.[6] ..... G08B 0/00

[52] U.S. Cl. ..... 340/286.01; 340/426; 340/825.31; 307/10.3; 307/10.5

[58] Field of Search ..... 340/286.01, 426, 340/825.34, 825.31, 825.54; 307/10.3, 10.5, 10.6; 116/33; 368/6; 364/424.037

[56] References Cited

U.S. PATENT DOCUMENTS 5,539,260 7/1996 Khangura et al. ..... 307/10.3
5,555,863 9/1996 Kokubu ..... 307/10.3 X
5,610,574 3/1997 Mutoh et al. ..... 340/426
5,635,900 6/1997 Hasegawa et al. ..... 340/426

*Primary Examiner*—Jeffery Hofsass
*Assistant Examiner*—Anh La
*Attorney, Agent, or Firm*—Oliff & Berridge, P.L.C.

[57] ABSTRACT

In a vehicular communication system, a microcomputer of a transmission-reception electronic control unit (ECU) transmits stored data via an antenna coil to a transceiver disposed in an ignition key when the ignition key is inserted in an ignition key cylinder of a vehicle. During communication with the transceiver, the microcomputer outputs a key interlock actuating signal. While the key interlock actuating signal is being inputted to a key interlock control circuit, the key interlock control circuit operates a key interlock actuator to prevent the ignition key cylinder from being turned to a position at which the ignition key may be freely removed from the ignition key cylinder. Thus, the ignition key is prevented from being removed from the ignition key cylinder during communication between the ignition key transceiver and the microcomputer, thereby ensuring that data about the vehicle will be stored in a reception device disposed in the ignition key without a failure.

19 Claims, 8 Drawing Sheets

VEHICULAR COMMUNICATION SYSTEM USING AN IGNITION KEY

BACKGROUND OF THE INVENTION

1. Field of the Invention

The present invention relates to a vehicular communication system in which data are transmitted from a vehicle to a reception device provided in an ignition key and stored in the reception device when the ignition key is inserted into an ignition key cylinder.

2. Description of the Related Art

A conventional system is known in automotive engineering, in which log data for a motor vehicle are stored in an integrated circuit (IC) card. The log data are useful for managing service operations for the motor vehicle, for example tracking and scheduling preventive maintenance.

However, the conventional system requires a driver to carry an IC card in addition to an ignition key. Further, the driver must insert the IC card in a predetermined location in the motor vehicle every time the driver gets in and starts the motor vehicle. This is inconvenient for the driver. In addition, the driver may forget to insert the IC card. Accordingly, the conventional system may record incomplete engine log data, thus disrupting management of service operations for the motor vehicle.

SUMMARY OF THE INVENTION

The present invention provides a vehicular communication system that ensures that data will be reliably transmitted from a vehicle to a reception device provided in an ignition key for the vehicle.

The vehicular communication system of the present invention includes an ignition key having a reception device for storing data received from an antenna coil, an ignition key cylinder and a transmission device. The ignition key cylinder has at least a key removal position at which the ignition key can be freely pulled out of the ignition key cylinder, and a key removal prevention position at which the inserted ignition key cannot be pulled out of the ignition key cylinder. When the ignition key cylinder is in the key removal prevention position, the transmission device transmits stored data from an antenna coil near the ignition key cylinder to the ignition key reception device according to a predetermined communication timing sequence. The vehicular communication system also includes a transmission interrupt prevention device for preventing the ignition key cylinder from being switched from the key removal prevention position to the key removal position when data is being transmitted from the transmission device to the ignition key reception device.

Thus, when the ignition key cylinder has been switched to the key removal prevention position using the ignition key, the transmission device transmits the stored data from the antenna coil provided near the ignition key cylinder to the ignition key reception device according to the predetermined communication timing sequence, and the ignition key reception device stores the data. The data preferably includes log information about the motor vehicle.

The transmission interrupt prevention device prevents the ignition key cylinder from being switched from the key removal prevention position to the key removal position during data transmission. Thus, the ignition key cannot be accidentally or purposefully pulled out from the ignition key cylinder during the data transmission. Accordingly, data can be reliably transmitted to the ignition key reception device.

It is preferred that the ignition key reception device store an identification code for identifying the ignition key, and that a control device be provided that reads the identification code from the reception device when the ignition key is inserted in the ignition key cylinder. If the identification code read from the ignition key by the control device conforms to a code registered beforehand, the control device allows actuation of the ignition key cylinder to start the engine of the vehicle. If the identification code does not conform to the pre-registered code, then the control device preferably immobilizes the ignition key cylinder to prevent the engine from being started.

It is also preferred that a) the predetermined communication timing sequence include at least a time during which the engine is stopped, b) the key removal prevention position of the ignition key cylinder be an accessory position or an on-position of the ignition key cylinder, and c) the key removal position be a lock position of the ignition key cylinder.

The transmission interrupt prevention device may be a key interlock actuator that prevents the ignition key cylinder from being switched from the key removal prevention position to the key removal position. By using the key interlock actuator as a transmission interrupt prevention device, the construction of the vehicular communication system can be simplified.

BRIEF DESCRIPTION OF THE DRAWINGS

Features and advantages of the present invention will become apparent from the following description of a preferred embodiment with reference to the accompanying drawings, in which like reference numerals refer to like elements and wherein.

DETAILED DESCRIPTION OF PREFERRED EMBODIMENT

A preferred embodiment of the vehicular communication system according to the invention will be described with reference to FIGS. 1 through 7.

Figure 1:
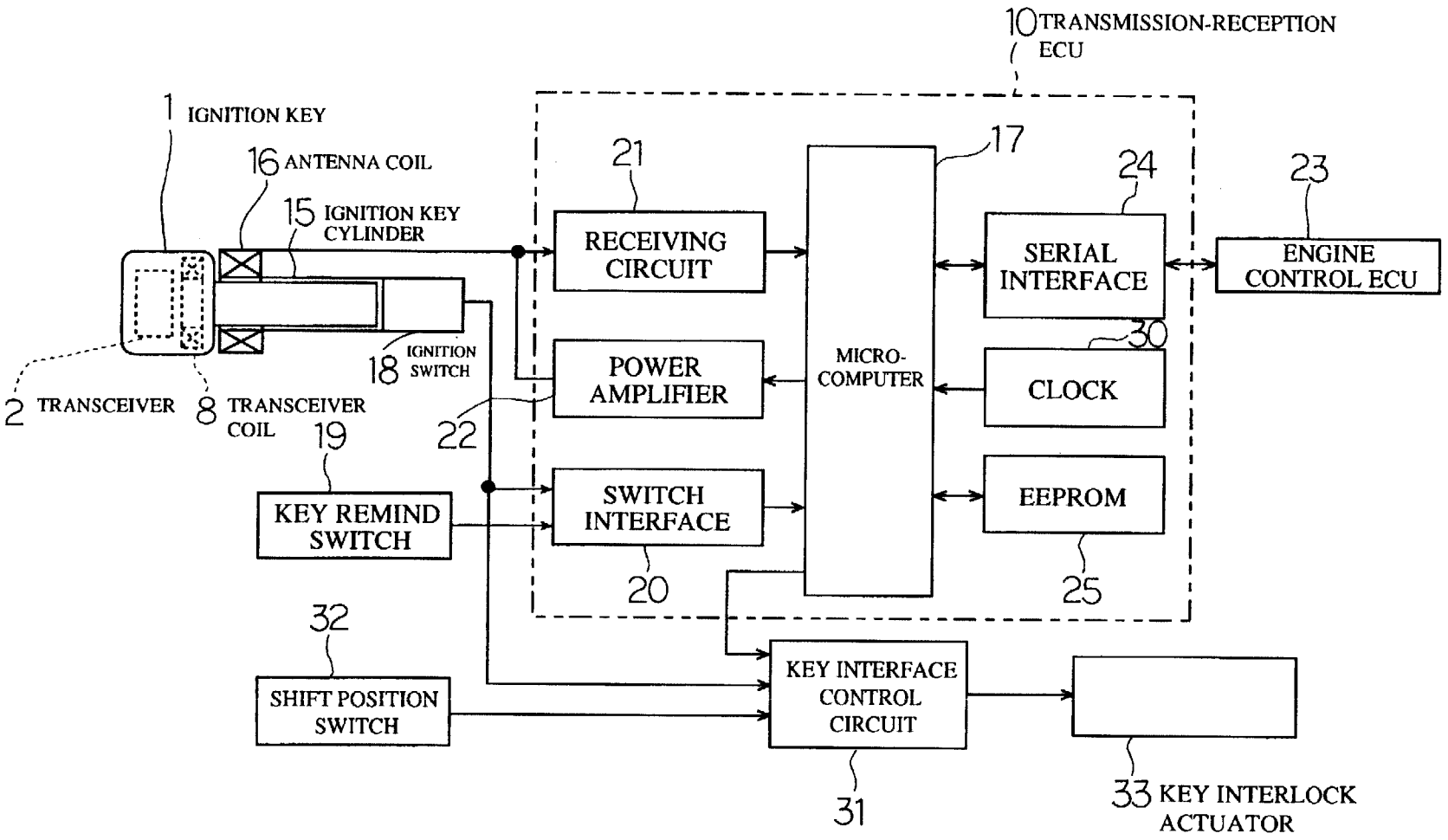
FIG. 1 is a functional block diagram illustrating the overall construction of a preferred embodiment of the vehicular communication system of the present invention.
Figure 2:
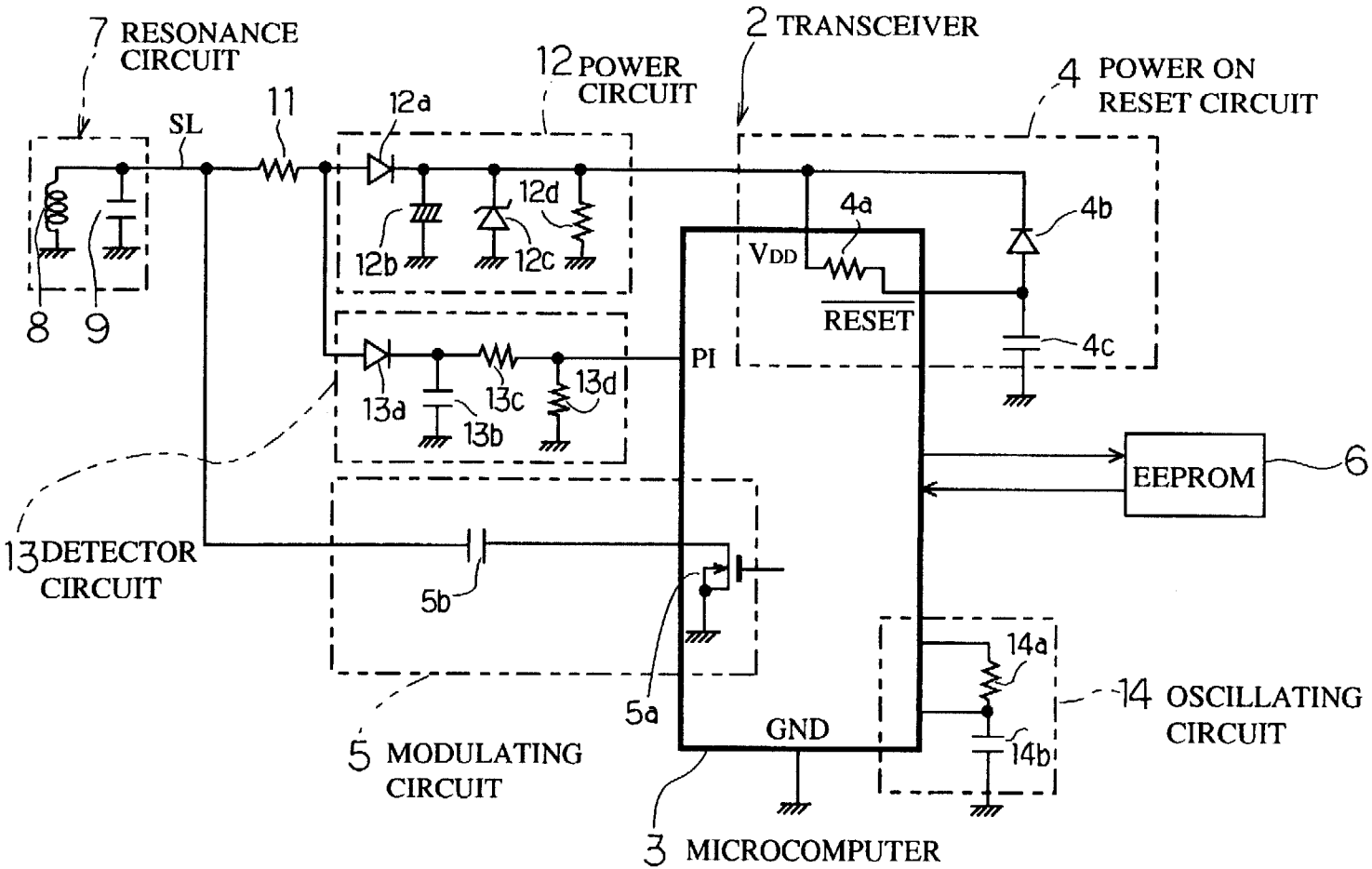
FIG. 2 is a circuit diagram of a transceiver according to the preferred embodiment.

FIG. 2 illustrates an electrical circuit diagram of a transceiver 2, or ignition key reception device, provided in the form of a unit in a key bow of an ignition key 1 (shown in FIG. 1) of a motor vehicle.

The transceiver 2 includes a microcomputer 3. Upon receiving a carrier wave signal and an enquiry signal from an external source (not shown), the transceiver 2 responds to the enquiry signal by sending back an answer signal including an identification code ΔB assigned beforehand. The construction of the transceiver 2 will be described in detail below.

The microcomputer 3 contains a resistor 4*a* of a power-on reset circuit 4 described below, and an N-channel field effect transistor (FET) 5*a* of a modulating circuit 5 described below.

The microcomputer 3 is connected to an EEPROM 6, and writes data into and reads data from the EEPROM 6. The EEPROM 6 stores a calculating code ΔC and the identification code ΔB specific to the corresponding ignition key 1, and also stores a function expression f for generation of cipher codes, that will be described further below.

A resonance circuit portion 7 includes a transceiver coil 8, provided as a reception coil, and a resonance capacitor 9 that are connected in parallel between a signal line SL and a ground terminal. The resonance frequency is preset to equal the frequency band of the carrier wave signal transmitted from a transmission-reception electronic control unit (ECU) 10 (shown in FIG. 1) provided in the motor vehicle for serving as a transmission-reception device and control unit.

A power circuit 12, connected to the signal line SL by a resistor 11, rectifies and smooths the carrier wave signal received by the resonance circuit portion 7 and sends the thus-obtained output to a power terminal VDD of the microcomputer 3. The power circuit 12 includes a rectifying diode 12*a*, a smoothing capacitor 12*b*, a constant-voltage diode or Zener diode 12*c* and a resistor 12*d* that are connected as shown in FIG. 2.

A detector circuit 13, connected to the signal line SL by the resistor 11, discriminates the enquiry signal supplied together with the carrier wave signal through the resonance circuit portion 7, and sends the discriminated signal to an input port PI of the microcomputer 3. The detector circuit 13 is formed as a filter circuit including a detector diode 13*a*, a capacitor 13*b*, and resistors 13*c*, 13*d* that are connected as shown in FIG. 2.

The time constant of the detector circuit 13 is preset to a value significantly lower than the charging time constant of the smoothing function portion of the power circuit 12 to enable the discrimination of enquiry signals.

The modulating circuit 5, including the FET 5*a*, is connected in parallel to the resonance capacitor 9 of the resonance circuit portion 7. In the modulating circuit 5, a modulating capacitor 5*b* and the source and drain of the FET 5*a* are connected in series. The impedance of the resonance circuit portion 7 can be changed in accordance with the turning on and off of the FET 5*a*.

The reset circuit 4 performs the power-on reset function of holding the microcomputer 3 in a reset state until the level of power supplied to the power terminal VDD of the microcomputer 3 (the output voltage level of the power circuit 12) reaches or exceeds a predetermined level. The reset circuit 4 includes a diode 4*b*, a capacitor 4*c* and the resistor 4*a* connected as shown in FIG. 2. An oscillating circuit 14 includes a resistor 14*a* and a capacitor 14*b*, and determines the clock frequency of the microcomputer 3.

The functions of the transceiver 2 will be described in conjunction with the control functions of the microcomputer 3.

When the resonance circuit portion 7 receives a carrier wave signal and an enquiry signal including a predetermined random number code ΔA from the transmission-reception ECU 10 as described below, the power circuit 12 rectifies and smoothes the carrier wave signal and outputs the signal to the power terminal VDD of the microcomputer 3. When the output power reaches or exceeds a predetermined level, the reset state held by the reset circuit 4 is canceled, and the microcomputer 3 is thus switched to an active state. In addition, the detector circuit 13 discriminates the enquiry signal received and then outputs it to the input port PI of the microcomputer 3.

The thus-activated microcomputer 3 operates the modulating circuit 5 in response to the enquiry signal supplied through the detector circuit 13, to perform the transceiver function of transmitting (sending back), through the resonance circuit 7, an enciphered answer signal including the identification code ΔB read from the EEPROM 6.

The microcomputer 3 is designed to perform the encipherment of answer signals. For Example, upon receiving an enquiry signal, the microcomputer 3 reads the identification code ΔB, the calculating code ΔC and the function expression f from the EEPROM 6, and carries out a function calculation using the random number code ΔA included in the enquiry signal, the identification code ΔB and the calculating code ΔC as variables, that is, the calculation of the function f(ΔA, ΔB, ΔC). The calculation result is a cipher code ΔD.

Then the microcomputer 3 performs on-off control of the FET 5*a* of the modulating circuit 5 in a mode corresponding to the cipher code ΔD, to change the impedance of the resonance circuit portion 7. The received carrier wave signal is thereby modulated in amplitude in a mode corresponding to the cipher code ΔD. The change of the impedance of the resonance circuit portion 7 achieved by the modulating circuit 5 is detected by the transmission-reception ECU 10. In this manner, the enciphered answer signal is sent back to the transmission-reception ECU 10.

Upon receiving data from the detector circuit 13, the microcomputer 3 sequentially stores the received data into the EEPROM 6.

FIG. 1 schematically illustrates the overall construction of the system by a combination of the functional blocks. An antenna coil 16 is provided around an ignition key cylinder 15 of the motor vehicle. When the ignition key 1 is insert in the cylinder 15, the antenna coil 16 is electromagnetically coupled with the transceiver coil 8 (see FIG. 2) contained in the ignition key 1.

The transmission-reception ECU 10 of the motor vehicle includes a microcomputer 17. The microcomputer 17 receives on-signals from a key remind switch 19 and an ignition switch 18 that are provided corresponding to the cylinder 15 as is well known in the art, via a switch interface 20. The signals received by the antenna coil 16 are inputted to the microcomputer 17 through a receiving circuit 21.

The microcomputer 17 controls the transmission through the antenna coil 16 via an output from a power amplifier 22. This control will be described below. The microcomputer 17 sends signals to and receives signals from an engine control ECU 23 through a serial interface 24. The microcomputer 17 performs an immobilization function by selectively preventing the engine control ECU 23 from performing an engine starting operation.

In addition, the microcomputer 17 outputs data to and reads data from an EEPROM 25. Pre-stored in the EEPROM 25 are the random number code ΔA, and the same identification code ΔB, calculating code ΔC and function expression f as the identification code ΔB, calculating code ΔC and function expression f stored in the EEPROM 6 of the ignition key 1 provided corresponding to the motor vehicle.

Figure 3:
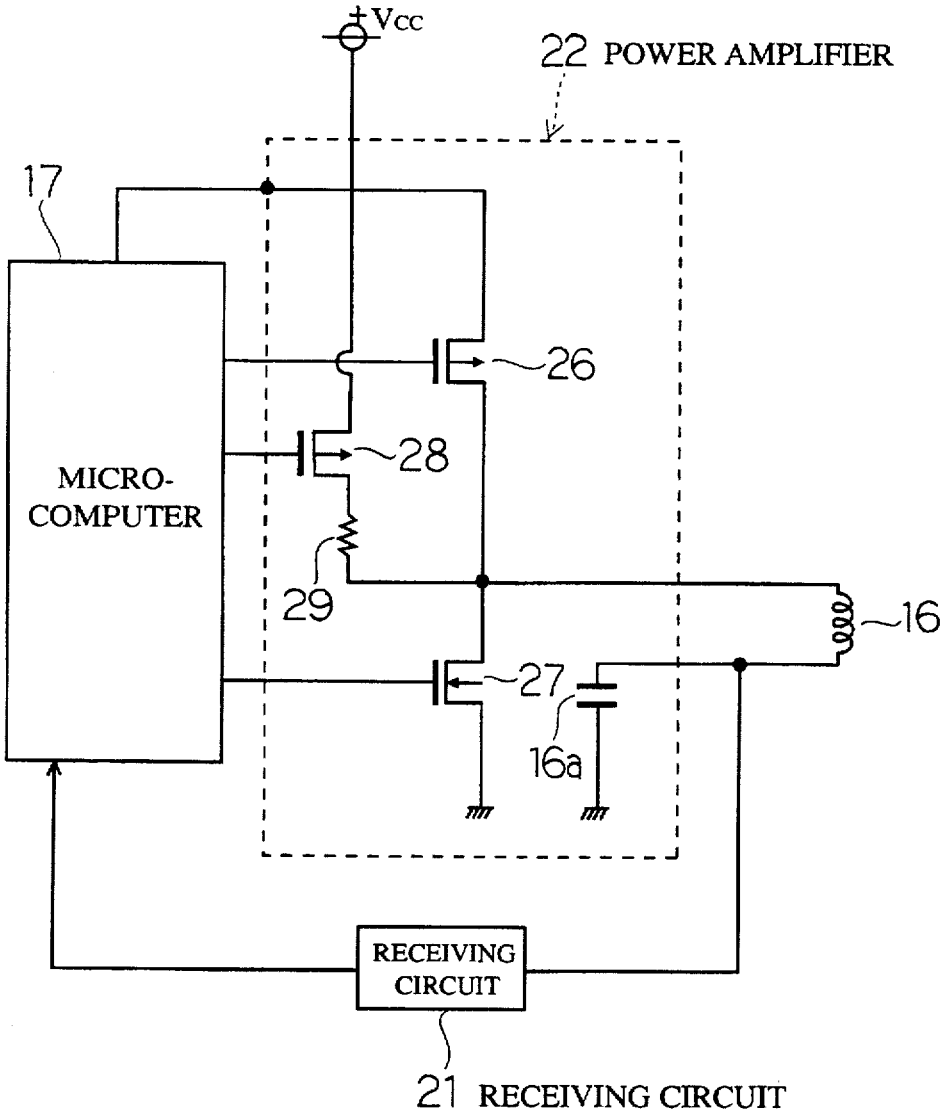
FIG. 3 is a circuit diagram of a power amplifier.

The detailed construction of the power amplifier 22 is shown in FIG. 3. Connected between the power terminal +VCC and the ground terminal are a P-channel FET 26 and an N-channel FET 27 that form a push-pull circuit. A series circuit of another P-channel FET 28 and a resistor 29 is connected in parallel to the P-channel FET 26. The FETs 26–28 are on-off controlled by the microcomputer 17. The antenna coil 16 is connected to a resonance capacitor 16*a*, thus forming a series resonance circuit. The power amplifier 22 supplies the antenna coil 16 with AC power of a frequency equal to (or close to) the resonance frequency of the series resonance circuit formed by the antenna coil 16 and the resonance capacitor 16*a*.

The power amplifier 22 is switchable between a state in which the power amplifier 22 supplies AC power to the antenna coil 16 by alternately turning on the FETs 26 and 27, and a state in which it supplies AC power to the antenna coil 16 by alternately turning on the FETs 28 and 27. The alternate turning on and off of the FETs 26, 27 provides relatively high power to the antenna coil 16, whereas the alternate turning on and off of the FETs 28, 27 supplies a reduced power to the antenna coil 16 because the resistor 29 reduces the current supplied to the antenna coil 16.

When the microcomputer 17 determines that the ignition key cylinder 15 has been switched from the LOCK position to the accessory (ACC) position on the basis of the detection signal from the ignition switch 18, the microcomputer 17 reads a current time from a clock 30 (shown in FIG. 1) and transmits the current time to the transceiver 2. After checking that the current time has been written into the EEPROM 6 of the transceiver 2, the microcomputer 17 outputs a key interlock actuating signal to a key interlock control circuit 31 (shown in FIG. 1).

When the microcomputer 17 determines that the ignition key cylinder 15 has been operated from the ON position to the ACC position, the microcomputer 17 reads the current time from the clock 30 and transmits the current time to the transceiver 2. After checking that the current time has been written into the EEPROM 6 of the transceiver 2, the microcomputer 17 stops outputting the key interlock actuating signal to the key interlock control circuit 31.

The key interlock control circuit 31 is designed to turn on and off a key interlock actuator 33 (shown in FIG. 1) in accordance with the key interlock actuating signal from the microcomputer 17, a switch signal from the ignition switch 18, and a position signal from a shift position switch 32. The shift position switch 32 (shown in FIG. 1) indicates shift lever position and the on/off state of a shift lever button provided for allowing or preventing shift lever operation.

When turned on, the key interlock actuator 33 prevents the ignition key cylinder 15 from being switched from the ACC position to the LOCK position. The key interlock control circuit 31 activates the key interlock actuator 33 when the ignition key cylinder is switched from the LOCK position to the ACC position, and deactivates the key interlock actuator 33 when all of the following conditions are established:

(1) The ignition key cylinder 15 has been operated from the ON position to the ACC position;

(2) The shift position switch 32 is in the parking range position and the shift lever button is off; and (3) The key interlock actuator 33 is not receiving the key interlock actuating signal from the microcomputer 17.

Figure 4:
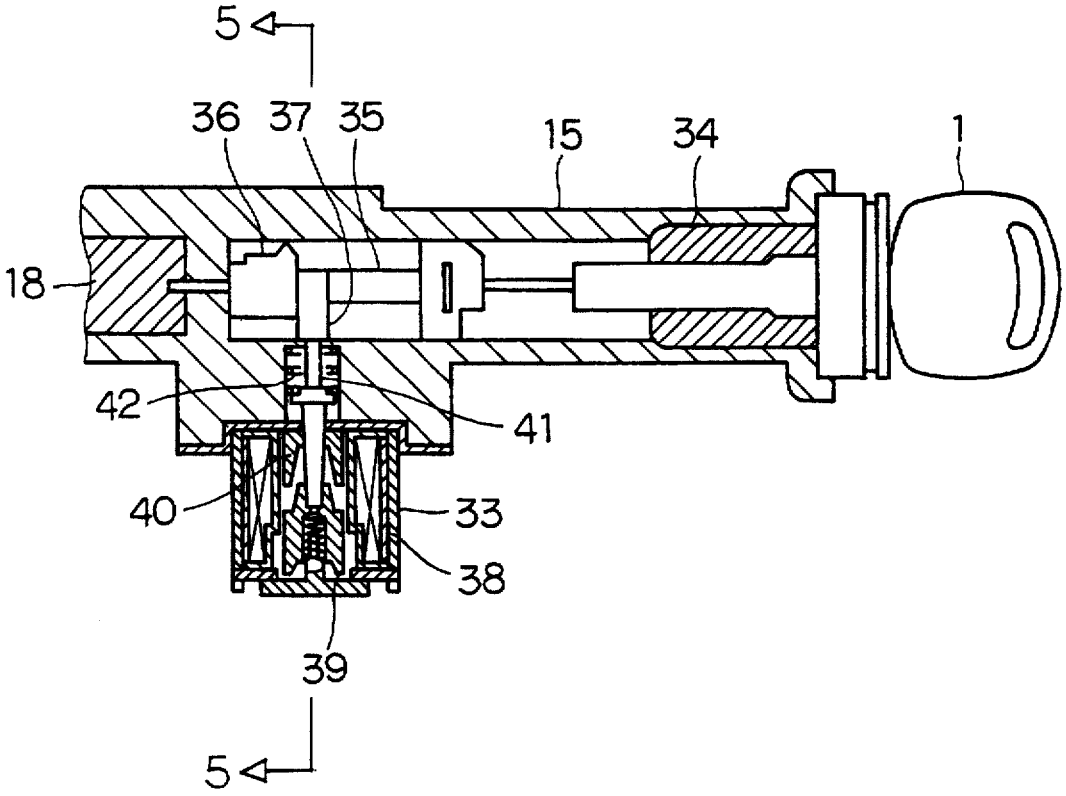
FIG. 4 is a longitudinal sectional view of a key cylinder and a key interlock device according to the preferred embodiment.
Figure 5:
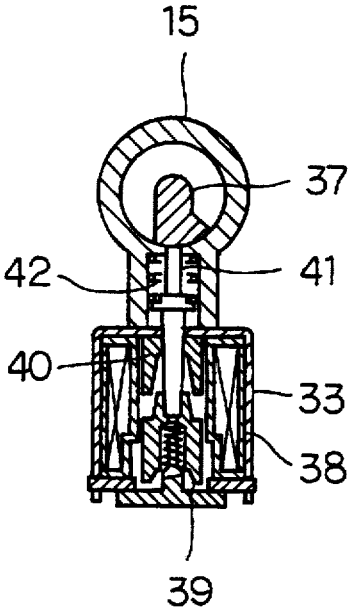
FIG. 5 is a cross sectional view of the key cylinder and the key interlock device of FIG. 4 along the plane 5—5 shown in FIG. 4.
Figure 6:
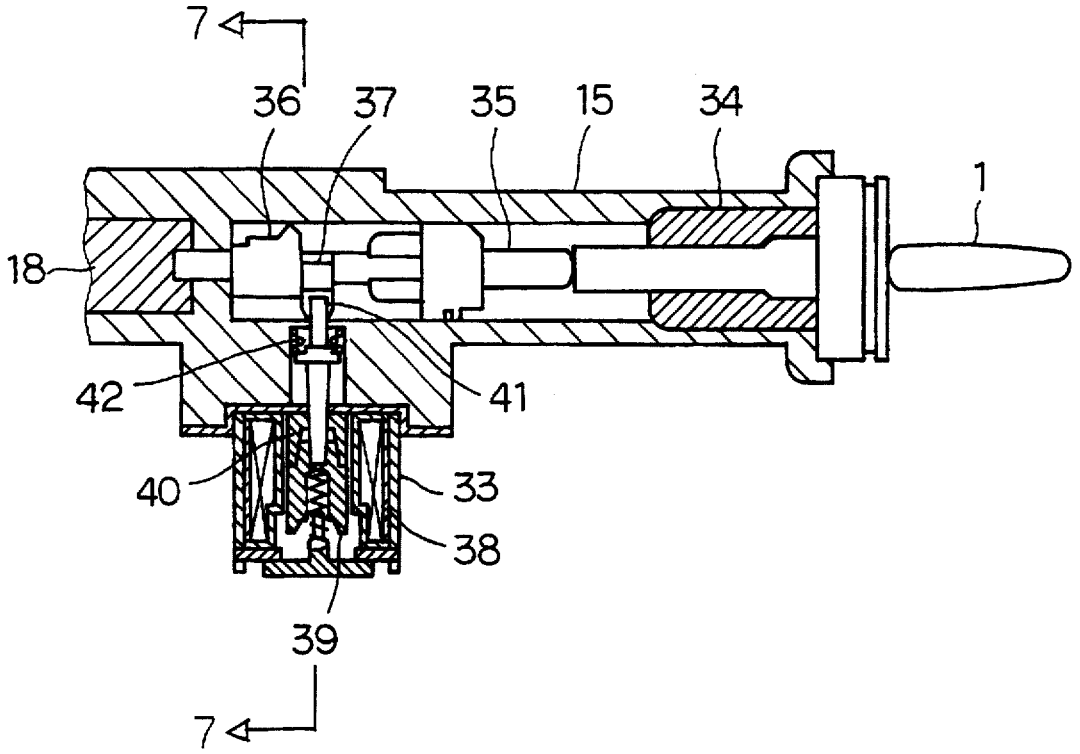
FIG. 6 illustrates the key cylinder and key interlock device of FIG. 4, in an operational state different from that shown in FIG. 4.
Figure 7:
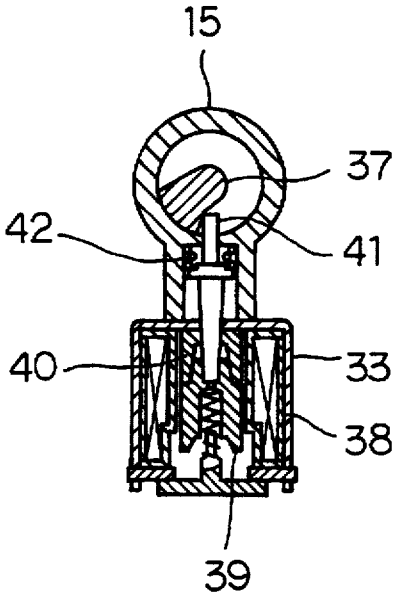
FIG. 7 is a cross sectional view of the key cylinder and the key interlock device of FIG. 6 along the plane 7—7 shown in FIG. 6.

The construction of the ignition key cylinder 15 and the key interlock actuator 33 will be described with reference to FIGS. 4 through 7. Referring first to FIGS. 4 and 5, the ignition key cylinder 15, mounted on a steering column (not shown), has a key rotor 34 that is rotatably disposed in an opening end of the key cylinder 15. When the ignition key 1 is inserted in the key rotor 34, the key rotor 34 is allowed to be rotated to the LOCK position, the ACC position, the ON position and the START position. The ignition key 1 can be pulled out of the key rotor 34 only when the key rotor 34 is in the LOCK position, that is, the rotor locking position.

The ignition switch 18 is mounted on an inside end of the ignition key cylinder 15, remote from the key rotor 34. The ignition switch 18 is fitted to an end of a cam shaft 35 rigidly connected to the key rotor 34. Thus the rotation of the key rotor 34, that is, the rotation of the ignition key 1, is transmitted to the ignition switch 18 by the cam shaft 35.

The inside end portion of the cam shaft 35 has a cam protuberance 36 for moving a lock bar (not shown) as the cam shaft 35 rotates. When the ignition key 1 is in the LOCK position, the end of the lock bar protrudes to prevent a steering shaft of the motor vehicle from rotating.

The cam shaft 35 is integrated with a cam 37. The key interlock actuator 33 is connected to the ignition key cylinder 15 corresponding to the cam 37.

The key interlock actuator 33 is constructed so that a plunger part 39 is attracted to a core 40 when a key interlock solenoid 38 is energized. When the plunger part 39 is drawn to the core 40, a lock pin 41 protrudes or moves into the rotation locus of the cam 37 against the force of a compressed coil spring 42, thereby preventing the ignition key cylinder 15 from turning from the ACC position to the LOCK position. See, e.g., FIGS. 6 and 7.

When the key interlock solenoid 38 is not energized, the lock pin 41 is held in a withdrawn position indicated in FIGS. 4 and 5 by the compressed coil spring 42, thus allowing the ignition key cylinder 15 to turn from the ACC position to the LOCK position.

According to the preferred embodiment, the above-described key interlock actuator 33 is a safeguard device normally provided in automatic transmission vehicles. As a safeguard, the key interlock actuator 33 allows the ignition key cylinder 15 to be turned from the ACC position to the LOCK position only when the shift lever is in the parking position. As a result, the shift lever is always in the parking position when the ignition key 1 is removed from the ignition key cylinder 15.

The control by the microcomputer 17 of the transmission-reception ECU 10 will be described in conjunction with the functions of related components.

When the microcomputer 17 receives on-signals from the key remind switch 19 and the ignition switch 18, that is, when the ignition key 1 is inserted into the cylinder 15 and turned to the ON position the antenna coil 16 and the transceiver coil 8 of the ignition key 1 are electromagnetically coupled. Upon receiving the on-signals, the microcomputer 17 generates a pulse-train enquiry signal including a random number code ΔA read from the EEPROM 25, and operates the power amplifier 22 to transmit from the antenna coil 16 a predetermined-frequency carrier wave signal and an enquiry signal convoluted therewith including the random number code ΔA.

For convoluting the enquiry signal with the carrier wave signal, the microcomputer 17 reduces the power supplied to the antenna coil 16 by alternately turning on and off the FETs 28 and 27 in the power amplifier.

The carrier wave signal and the enquiry signal are thus transmitted from the antenna coil 16 to the transceiver 2 (see FIG. 2) of the ignition key 1.

In response to the carrier wave signal, the microcomputer 3 of the transceiver 2 will be switched to the active state. The microcomputer 3 then deciphers the enquiry signal on the basis of the timing sequence according to which the level of the carrier wave signal decreases. In accordance with the enquiry signal, the microcomputer 3 determines a cipher code ΔD by performing a function calculation using the random number code ΔA included in the enquiry signal, the identification code ΔB, the calculating code ΔC and the function expression f stored in the EEPROM 6, and sends back an answer signal enciphered by the cipher code ΔD, thus performing the transceiver function.

The microcomputer 17 performs a decoding operation, i.e., determines a cipher code ΔD by calculating f(ΔA, ΔB, ΔC) using the random number code ΔA, the identification code ΔB, the calculating code ΔC and the function expression f read from the EEPROM 25, and compares the resulting cipher code ΔD with the cipher code ΔD included in the answer signal from the transceiver 2. If the two cipher codes do not agree, the microcomputer 17 prevents the engine control ECU 23 from starting the engine of the motor vehicle.

Therefore, if the ignition switch 18 is turned on by an ignition key 1 having an incorrect identification code, the motor vehicle engine cannot be started. Security against theft is thus enhanced.

If the decoding operation finds that the cipher code ΔD calculated by the microcomputer 17 agrees with the cipher code ΔD included in the answer signal from the transceiver 2, the microcomputer 17 permits the engine control ECU 23 to start the motor vehicle engine.

In short, the starting of the motor vehicle engine by the engine control ECU 23 is allowed if the ignition cylinder 15 receives an ignition key 1 having correct cipher codes generated based on the identification codes ΔB and other parameters. The preferred embodiment of the vehicular communication system thus performs an immobilization function.

After permitting start up of the motor vehicle engine, the microcomputer 17 reads the current time (i.e., the engine start time) from the clock 30, and transmits the engine start time to the transceiver 2 via the antenna coil 16.

The microcomputer 3 of the transceiver 2 receives the engine start time transmitted from the transmission-reception ECU 10 and stores it in the EEPROM 6. Then, to perform a data check, the microcomputer 3 reads out the engine start time from the EEPROM 6 and transmits it back to the transmission-reception ECU 10.

The microcomputer 17 of the transmission-reception ECU 10 checks whether the engine start time transmitted back from the transceiver 2 is correct. If it is not correct, the microcomputer 17 again transmits the correct engine start time to the transceiver 2 via the antenna coil 16. Before a driver gets out of the vehicle, the driver moves the shift lever to the P (parking) position and then turns the ignition key 1 from the ON position to the ACC position to stop the engine.

At this moment, the microcomputer 17 of the transmission-reception ECU 10 reads the current time (i.e., the engine stop time) from the clock 30, and transmits it via the antenna coil 16 to the transceiver 2. The microcomputer 3 of the transceiver 2 receives the engine stop time transmitted from the transmission-reception ECU 10 and stores it in the EEPROM 6. The microcomputer 17 then obtains the engine stop time written into the EEPROM 6 from the transceiver 2 and checks whether it is correct. If the engine stop time received from the transceiver 2 is correct, the microcomputer 17 stops outputting the key interlock actuating signal.

Next, the key interlock control circuit 31 determines that the conditions for discontinuing the key interlock are met, and turns off the key interlock actuator 33. The supply of power to the key interlock solenoid 30 is thus discontinued so that the lock pin 41 projected into the rotation locus of the cam 37 recedes, thus allowing the ignition key 1 to be turned. Then the driver can turn the ignition key 1 from the ACC position to the LOCK position and pull the ignition key 1 out of the cylinder 15.

However, there is a danger that the ignition key 1 may be pulled out of the cylinder 15 before the transmission of data to and from the transceiver 2 is completed, resulting in incomplete or incorrect data being written in the EEPROM 6 of the transceiver 2. In fact, the transmission of data to and from the transceiver 2 will take a relatively long time if the information to be written into the EEPROM 6 of the transceiver 2 is large when the engine is stopped, or if an error occurs when data are transmitted to and from the transceiver 2 at the engine start time.

To ensure that transmission of data to and from the transceiver 2 is not interrupted, the microcomputer 17 of the transmission-reception ECU 10 continues outputting the key interlock actuating signal until the communication between the microcomputer 17 and the transceiver 2 ends.

As long as the key interlock actuating signal is being outputted, the key interlock control circuit 31 determines that the conditions for discontinuing the key interlock are not met, and continues operating the key interlock actuator 33, thus preventing the cylinder 15 from being turned from the ACC position to the LOCK position, and preventing the ignition key from being pulled out of the cylinder 15. Thus, the electromagnetic coupling between the transceiver coil 18 of the transceiver 2 of the ignition key 1 and the antenna coil 16 of the transmission-reception ECU 10 is maintained, thereby ensuring that data will be accurately transmitted to the transceiver 2 and written into the EEPROM 6 of the transceiver 2.

After confirming that data has been accurately received and recorded in the transceiver 2, the transmission-reception ECU 10 stops outputting the key interlock actuating signal. The key interlock control circuit 31 then determines that the key interlock discontinuation conditions are met, and turns off the key interlock actuator 33 thereby allowing the cylinder 15 to be turned from the ACC position to the LOCK position. With the cylinder 15 in the LOCK position, the driver can pull the ignition key 1 out of the cylinder 15.

Since the preferred embodiment uses the transceiver 2 provided in the ignition key 1 as a data carrier, and prevents the ignition key cylinder 15 from being turned from the ACC position to the LOCK position until transmission of data to and from the transceiver 2 ends, the preferred embodiment ensures that data about the vehicle will be written into the transceiver 2 without a failure.

In addition, since the preferred embodiment uses the key interlock actuator 33, which is normally installed in automatic transmission vehicles, as a mechanism for preventing the ignition key 15 from being turned from the ACC position to the LOCK position, the preferred embodiment does not require any additional device to perform this function, thus reducing costs.

Figure 8:
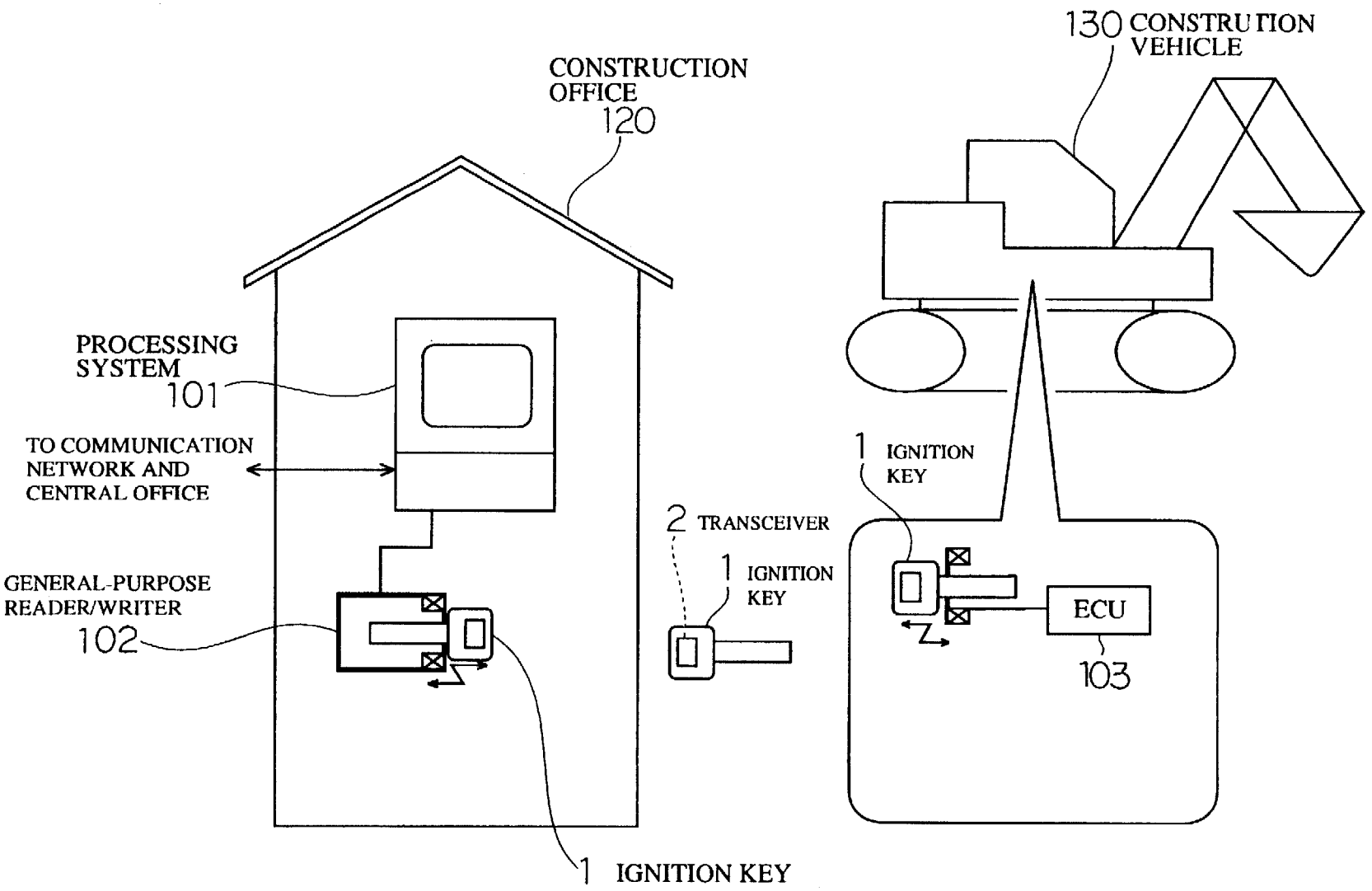
FIG. 8 illustrates a construction vehicle management system to which the preferred embodiment of the invention is applied.

FIG. 8 illustrates a construction vehicle management system incorporating the above-described embodiment. A processing system 101, provided in a construction office 120, includes a general-purpose reader/writer 102 for reading data recorded in the transceiver 2 of the ignition key 1.

A construction vehicle 130 is provided with an ID key system ECU 103 for storing into the transceiver 2 historical data relating to fuel charge, vehicle abnormality, maintenance, and service operation of the vehicle.

The ignition key cylinder (not shown) of the construction vehicle is constructed to prevent the ignition key from being turned to a key removal position during transfer of data to and from the transceiver 2, as in the above-described embodiment. Accordingly, the ID key system ECU 103 can reliably read vehicle operation history data from the transceiver 2 disposed in the ignition key 1 without a failure.

The processing system 101 reads the operation history stored in the transceiver 2, so that the vehicle operation history data can be used, for example, to monitor and schedule maintenance of the construction vehicle. Optionally, the processing system 101 can aggregate and process vehicle operation history data from multiple transceivers 2 corresponding to different vehicles, and transmit the aggregated and processed vehicle operation history data to a central office through a communication network, so that the operation histories of various construction vehicles can be centrally managed.

The vehicular communication system according to the preferred embodiment may be modified or expanded, for example as described below.

It is possible to provide separate coils for transmitting or receiving the carrier wave signal and the enquiry signal and for transmitting or receiving an answer signal in each of the transmission-reception ECU 10 and the transceiver 2.

If a vehicle has a manual transmission or if the vehicle has an automatic transmission but does not have a key interlock actuator 33, it is possible to provide an alternate mechanism for preventing the cylinder 15 from being turned from the ACC position to the LOCK position when the cylinder 15 is in the ACC position and the transmission-reception ECU 10 is outputting the key interlock actuating signal. As understood from the above description, since the vehicular communication system according to the preferred embodiment prevents the ignition key cylinder from being switched to a position at which an ignition key in the cylinder can be removed from the cylinder, if data are being transmitted to and from the ignition key in the cylinder and the cylinder is in a position that prevents removal of the ignition key. Thus, the vehicular communication system according to the described embodiment advantageously ensures that data about the vehicle will be stored in a reception device disposed in the ignition key without a failure.

While the present invention has been described with reference to what is presently considered to be a preferred embodiment thereof, it is understood that the invention is not limited to the disclosed embodiment or construction. To the contrary, the invention is intended to cover various modifications and equivalent arrangements included within the spirit and scope of the appended claims.

What is claimed is:

1. A vehicular communication system comprising:

an ignition key having a reception device for storing data received by a reception coil;

an ignition key cylinder switchable between at least a key removal position at which the ignition key can be freely pulled out of the ignition key cylinder and a key removal prevention position that prevents the ignition key from being pulled out of the ignition key cylinder;

a transmission device for transmitting stored data to the reception device during a predetermined communication time sequence while the ignition key is in the ignition key cylinder and the ignition cylinder is in the key removal prevention position; and switching prevention means for preventing the ignition key cylinder from being switched from the key removal prevention position to the key removal position during the predetermined communication time sequence.

2. The vehicular communication system according to claim 1, wherein the reception device stores an identification code for identifying the ignition key, and wherein the vehicular communication system further comprises control means for reading the identification code from the reception device when the ignition key is inserted in the ignition key cylinder and for effecting an engine starting operation on the ignition key cylinder when the identification code read from the reception device conforms to a pre-registered code.

3. The vehicular communication system according to claim 1 wherein the data stored in the ignition key reception device includes log data of a vehicle.

4. The vehicular communication system according to claim 1, wherein the predetermined communication time sequence includes at least a time during which an engine of a vehicle in which the vehicular communication system is located is stopped, and wherein the ignition key removal prevention position is one of an accessory position and an on-position of the ignition key cylinder, and the key removal position is a lock position of the ignition key cylinder.

5. The vehicular communication system according to claim 1, wherein the switching prevention means includes a key interlock actuator that prevents the ignition key cylinder from being switched from the key removal prevention position to the key removal position.

6. A vehicular communication system comprising:

an ignition key having an ignition key information device for receiving and storing data;

an ignition key cylinder;

a transmission device for transmitting data to the ignition key information device during a predetermined time interval; and a key removal prevention mechanism for preventing the ignition key from being removed from the ignition key cylinder during at least a portion of the predetermined time interval.

7. The vehicular communication system of claim 6, wherein the transmission device and the ignition key information device are electromagnetically coupled when the ignition key is inserted in the ignition key cylinder.

8. The vehicular communication system of claim 6, wherein the key removal prevention mechanism prevents the ignition key from being removed from the ignition key cylinder during the predetermined time interval.

9. The vehicular communication system of claim 6, wherein the key removal prevention mechanism prevents the ignition key from being removed from the ignition key cylinder when the transmission device transmits data to the ignition key information device.

10. The vehicular communication system of claim 6, wherein the data transmitted by the transmission device to the ignition key information device comprises log data of a vehicle.

11. The vehicular communication system of claim 10, wherein the log data comprises at least one of an engine start time and an engine stop time.

12. The vehicular communication system of claim 6, wherein the ignition key cylinder has at least a key removal position at which the ignition key can be removed from the ignition key cylinder, and a key removal prevention position at which the ignition key cannot be removed from the ignition key cylinder.

13. The vehicular communication system of claim 12, wherein the key removal position is one of an accessory position and an on-position of the ignition key cylinder, and the key removal position is a lock position of the ignition key cylinder.

14. The vehicular communication system of claim 6, wherein the ignition key information device comprises a transceiver for receiving data from the transmission device and sending data to the transmission device.

15. The vehicular communication system of claim 14, wherein the key removal prevention mechanism prevents the ignition key from being removed from the ignition key cylinder when data are communicated between the ignition key information device and the transmission device.

16. The vehicular communication system of claim 14, wherein the system verifies that the ignition key information device has correctly received data from the transmission device by sending the received data back from the ignition key information device to the transmission device, and verifying that the data sent from the transmission device to the ignition key information device are the same as the data subsequently sent from the ignition key information device to the transmission device.

17. The vehicular communication system of claim 14, wherein the ignition key information device stores an identification code for identifying the ignition key and the vehicular communication system further comprises a control device connected to the transmission device, wherein the control device enables an engine starting operation when the stored identification code communicated from the ignition key information device to the transmission device matches a predetermined identification code.

18. A method of communicating data between a control unit in a vehicle and an ignition key information device in an ignition key, comprising the steps of:

inserting an ignition key into an ignition key cylinder;

communicating data between the control unit and the ignition key information device; and preventing withdrawal of the ignition key from the ignition key cylinder during at least part of the step of communicating data between the control unit and the ignition key information device.

19. The method of claim 18, further comprising:

communicating an identification code from the ignition key information device to the control unit;

comparing the identification code received from the ignition key information device with a pre-registered identification code; and enabling an engine ignition sequence when the identification code received from the ignition key information device matches the pre-registered identification code.

* * * * *